United States Patent [19]

Barber et al.

[11] 4,241,432

[45] Dec. 23, 1980

[54] TRANSDUCER-REFLECTOR SYSTEM

[75] Inventors: Lewie M. Barber; Bernie R. Criswell; Ruell F. Solberg, Jr.; Benjamin F. L. Weiss, all of Austin, Tex.

[73] Assignee: The United States of America as represented by the Secretary of the Navy, Washington, D.C.

[21] Appl. No.: 635,950

[22] Filed: Apr. 21, 1967

[51] Int. Cl.[3] ..... H04R 17/00; H04R 1/34

[52] U.S. Cl. ..... 367/151; 367/155; 367/905

[58] Field of Search ..... 340/6, 6 S, 9, 10, 8 RT; 367/151, 154, 155, 905

[56] References Cited

U.S. PATENT DOCUMENTS

| | | | |
|---|---|---|---|
| 2,407,329 | 9/1946 | Turner, Jr. | 367/168 |
| 2,473,835 | 6/1949 | Turner, Jr. | 367/157 |
| 2,617,874 | 11/1952 | Lewis | 367/168 |
| 2,922,140 | 1/1960 | Levine et al. | 367/151 |
| 2,925,581 | 2/1960 | Hackley et al. | 367/138 |
| 3,243,768 | 3/1966 | Roshon, Jr. et al. | 367/151 |
| 3,284,760 | 11/1966 | Maes | 367/165 |

*Primary Examiner*—Richard A. Farley

*Attorney, Agent, or Firm*—R. S. Sciascia; A. L. Branning

[57] ABSTRACT

An acoustical line array transducer reflector system for producing conical shell radiation patterns. One side of the ground plane reflector of the system is covered with a chloroprene rubber-cork composition. Three transformers in ferrite cup cores are wired to the line array transducer elements.

3 Claims, 6 Drawing Figures

BY

BY

TRANSDUCER-REFLECTOR SYSTEM

This invention relates generally to acoustical transducers and more particularly to acoustical transducers for producing conical shell radiation patterns.

In the recent past several methods of obtaining conical shell radiation patterns have been proposed. One method contemplates an electrically phased line transducer with a single reflecting surface located at its base where both an upward and a downward pair of coaxial beams are emitted by the line transducer. The upward directed beam continues without modification but the downward directed beam is reflected upward at the same acoustic angle reinforcing the upward beam. The emitted result is a single upward directed conical beam caused by the reflector producing an image of the transducer which effectively doubles the length of the transducer line. Although theoretically sound, several problems exist in making such a structure feasible for an operable transducer reflector system. For example, in the proposed system it was thought that there might be a creation of unwanted acoustic reflections from the supporting structure and the use of transformers could bring about undesirable interactions between electrical and mechanical resonances of the line array. For proper operation an individual transformer was required for each transducer element thus involving a large amount of complicated winding and a possibility of inter-reacting resonances in the transformers and elements. In addition to these problems, a suitable pressure release material had not been found which provided the desired high reflectivity. This invention provides an improved conical shell radiation pattern line array transducer system which possesses the advantages of the prior art transducer systems but none of the aforedescribed disadvantages.

An object of the invention is to provide a new and improved line array transducer system.

Another object is the provision of a new and improved conical shell radiation pattern transducer system.

Still another object is to provide an improved conical shell radiation pattern line-array transducer reflector system.

Yet another object is the provision of transformer couplings to line array transducers wherein inter-reacting electrical and mechanical resonances are eliminated.

These and other objects are attained in accordance with the invention by providing a line array transducer reflector system which has one side of the ground plane reflector covered with a chloroprene rubber-cork composition and three transformers in ferrite cup cores wired to the transducer elements.

Other objects, features, and attendant advantages of this invention will be readily appreciated as the same becomes better understood by reference to the accompanying drawings wherein.

The improved apparatus according to the invention is most easily comprehended by description of a specific acoustic line transducer which was constructed in accordance therewith. The purpose of the transducer to be described is to measure bottom and surface reverberation at a grazing or deflecting angle of 30° with an acoustical beam of about 3° beamwidth.

Figure 1:
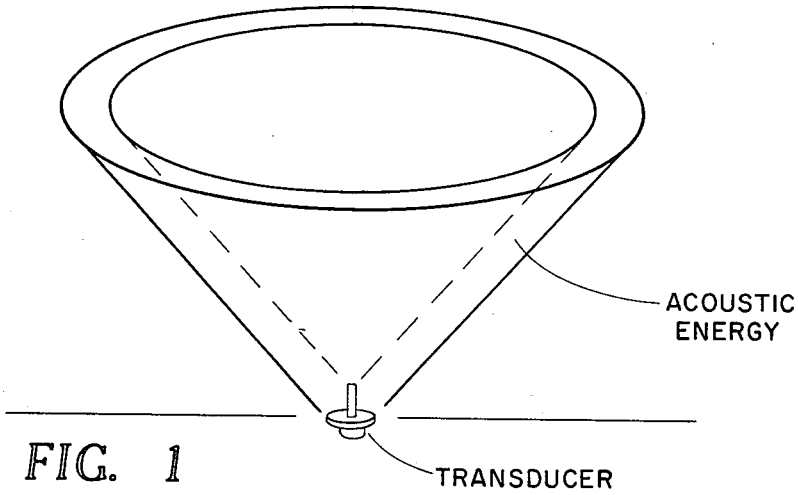
FIG. 1 is pictorial representation of a thin conical shell acoustic beam produced by a transducer constructed according to the invention.

The transducer has a directivily pattern like that of a thin conical shell as shown in FIG. 1. The particular choice of the right conical-shell pattern was made so that backward scattered data from all azimuthal angles from the ocean floor or surface could be obtained. This results in averaging of aspect dependence on ripple structure, surface waves, and other irregularities present at the interface of the water and the ocean surface or bottom. For the particular application described it is imperative that the side lobe reduction be as great as possible and yet be practical from the stand point of size and complexity. Something on the order of 25 to 30 db is desirable.

Figure 2:
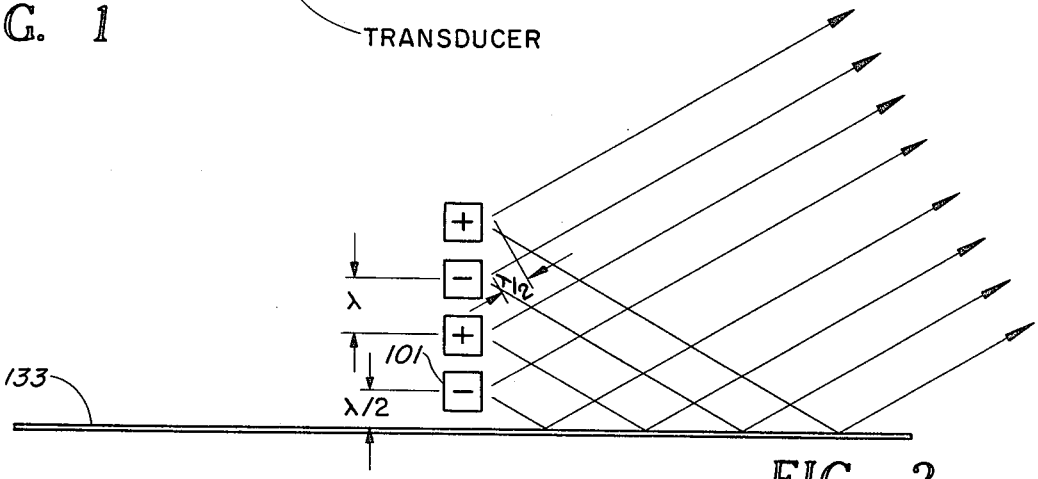
FIG. 2 illustrates the method of using a line transducer with a ground-plane reflector.

As shown in FIG. 2 the transducer-reflector system according to the invention has a line array of piezoelectric cylindrical elements 101, four of which are arranged schematically with a plane reflecting surface 133. In general the line array consists of an even number of hollow, piezoelectric cylinders whose centers in the length direction are spaced one wavelength, $\lambda$, apart and each element operates predominantly in the radial mode. The elements are driven 180° out of phase to their adjoining elements and the surface of the ground plane 133 is positioned one-half wavelength from the center of the nearest element of the transducer. The acoustic beam shown in FIG. 1 results from the combined upward beam and reflected beams from each element when electrical oscillations are supplied to the elements as shown in FIG. 2.

The vectors of these oscillations all have the same phase at the 30° incline. This is because the elements are spaced one wavelength apart, but the electrical signals are supplied at one-half wavelength separation. The acoustic signals emitted from successive elements differ by one-half wavelength in distance traveled to reach a plane perpendicular to the 30° incline so each arrives at the plane with the same phase. Signal cancellation, because of the phase difference, is obtained from the elements in varying amounts at all angles except for the two angles of 30° located each side of the perpendicular to the transducer axis. At these two angles the signals are in phase and add, but subtraction occurs at all other angles. The radiated oscillations which are directed toward the pressure release surface are reflected with an angle of reflection near the angle of incidence. The acoustical impedance mismatch between the water and ground plane, besides also causing the energy reflection, causes a phase shift of about 180 degrees. The reflected energy is then, in turn, near the same phase as the directly transmitted energy. Addition of these two beams then occurs to give a strengthened acoustical beam.

Figure 3:
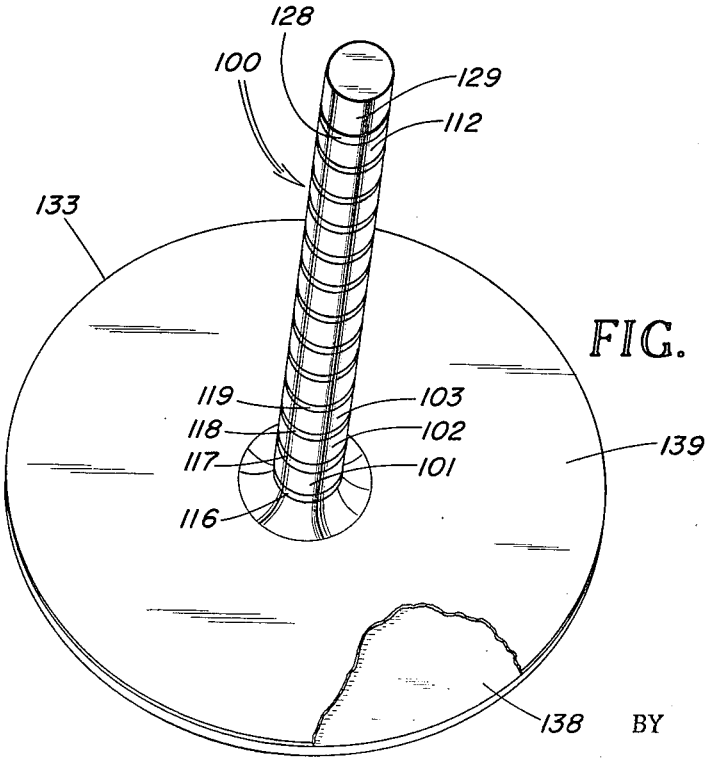
FIG. 3 is a top view of one embodiment of a transducer reflector system according to the invention.
Figure 4:
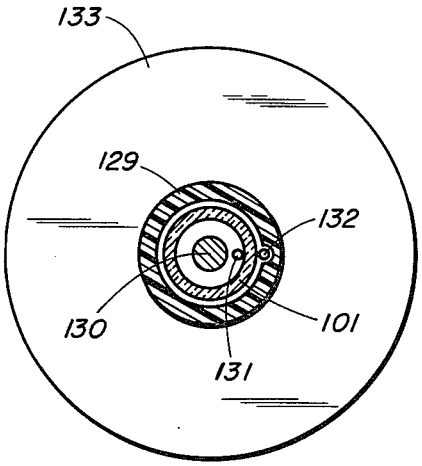
FIG. 4 is an axial cross-sectional view of a transducer reflector system constructed according to the invention.

Referring now to FIGS. 3 and 4, there is shown a twelve element, line transducer 100. Each of the twelve elements, 101 to 112 inclusive, are piezoelectric ceramic cylinders of lead zirconate which may be cut to equal lengths by a high speed diamond blade saw. They are silver plated on the inside and outside diameters before being polarized. Hollow aluminum cylinders and corprene rings, 116 to 128, serve to acoustically isolate each element so that cross coupling along the line is minimized and to provide center-to-center spacing of λ. The line array is encased in a castor oil filled, thin-walled polystyrene tubing 129 which is glued to the reflector 133. A center metal rod 130, shown in FIG. 4, serves to help align and support the elements in the line array. The rod 130 passes through the center of the array and has nuts at each end (not shown) to properly position the elements. The castor oil serves to acoustically connect the piezoelectric elements to the surrounding water. The reflector 133 is made of a large diameter, flat aluminum plate 138 which has one side covered with a chloroprene rubber-cork composition (corprene) 139. This composition is a pressure release material which has been found to have the desirable acoustical beam reflecting characteristics.

Figure 5:
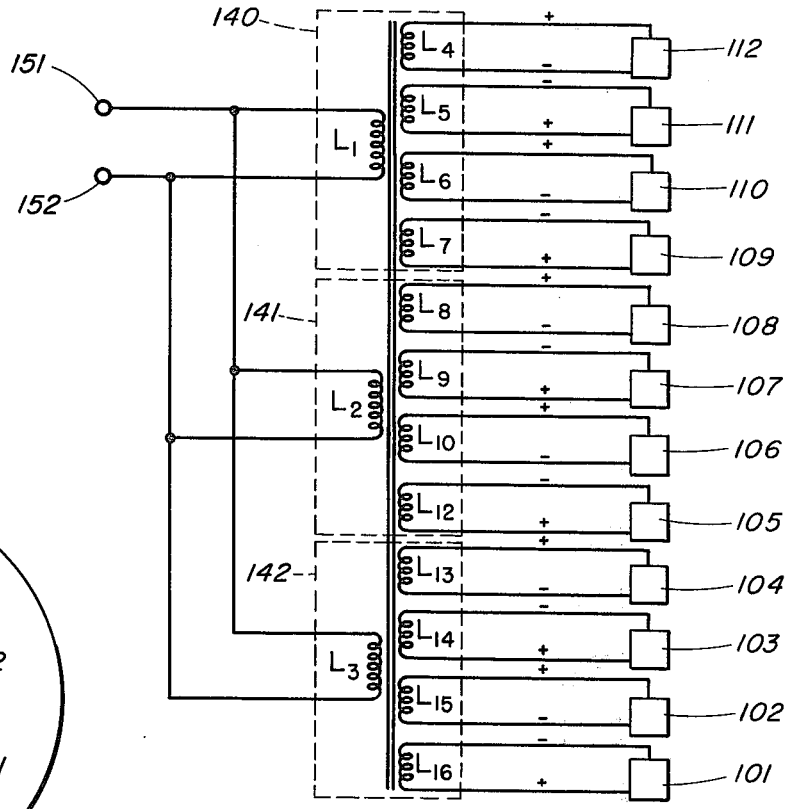
FIG. 5 is a circuit diagram of transformer to transducer element connections.

As shown in FIG. 5, a plurality of transformers 140, 141, and 142 are connected to transducer elements 101 to 112 to provide the desired directivity pattern. The individual elements are shaded by transformers according to the Dolph-Tschebyscheff optimum distribution method. For a discussion of the Dolph-Tschebyscheff optimum distribution method see Kraus, J. D., *Antennas* (McGraw-Hill Book Co., Inc., New York, 1950). Electrical oscillations are supplied to the elements from input cable leads 151 and 152 over secondary transformer winding leads which are connected to each element, one wire 131 (FIG. 4) connected to the inside and one wire 132 connected to the outside of the plated surfaces of the elements. The amplitude distribution to each ceramic element is accomplished by three transformers 140, 141, and 142 in ferrite cup cores with primary windings $L_1$to $L_3$ connected directly to input leads 151 and 152 and secondary windings $L_4$ to $L_{16}$ connected to the transducer elements. Each transformer has four transformer output circuits connected respectively to four transducer elements. Adjacent elements are oppositely connected to the shading transformers to provide 180° phase shift per element. The connection of the transformers in this manner substantially eliminates inter-reacting electrical and mechanical resonances.

In operation, when electrical oscillations are supplied to the elements, the elements in turn oscillate mechanically, transmitting their vibrations to the castor oil surrounding the elements. The castor oil is mechanically coupled to the plastic tube 129 which is coupled to the water or other medium surrounding the transducer 100. The castor oil and surrounding water are closely matched for acoustic impedance, and the acoustic impedance of polystyrene is near these. The vibrations of the elements then cause a wave train of vibrations to be radiated through the surrounding water.

Figure 6:
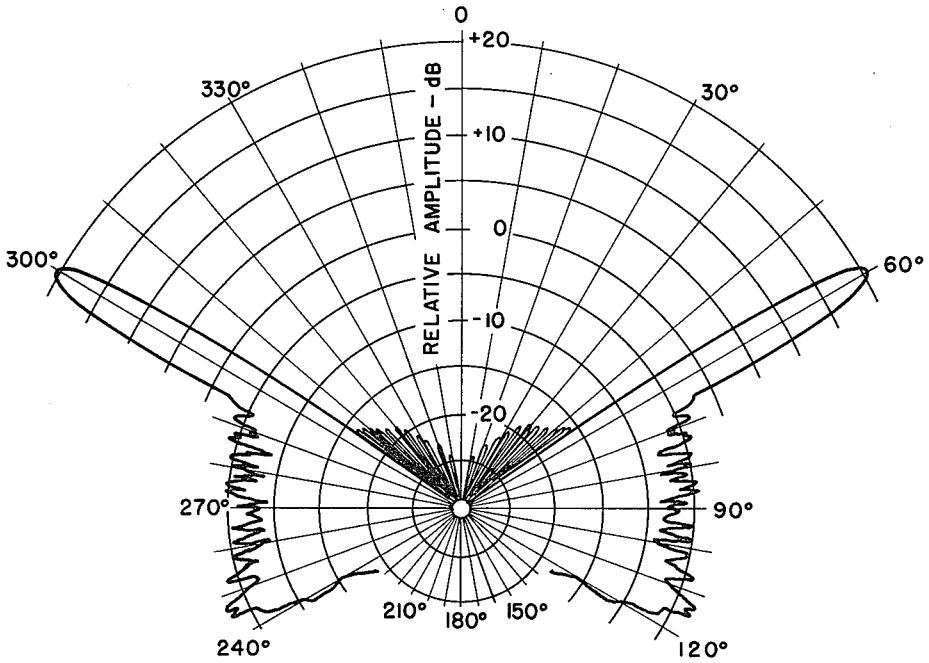
FIG. 6 is a graphical representation of the calculated directivity pattern of the acoustic transducer array shown in FIGS. 3 and 4.

FIG. 6 shows the calculated trasmit directivity pattern for the acoustic line transducer illustrated in FIGS. 3 and 4. It is to be noted that the side lobes are down about 25 db and the front lobes are down more than 35 db below the main lobes.

There are, of course, many alternatives possible in practicing the invention since the construction procedure, mechanical hardware, and types of materials used will vary greatly depending on the specific application. The transducer elements need not be limited to those with piezoelectric properties. For example, magnetostrictive or electrodynamic materials could be used. The line array need not necessarily be encased in a polystyrene tube and castor oil. A rubber tube could be used, or alternatively, the array could be contained in another type of plastic or other suitable material. Liquids such as silicone oil and various types of castor oil can be used inside the transducer so long as the liquids are of a high dielectric quality and reasonably uniform in their viscosity over the operable pressure and temperature range. Other foams and materials such as Celtite, syntactic, Styrofoam, or Dylite could be used as a pressure release material on the plane reflector, but corprene best withstands high hydrostatic pressures.

We claim as our invention:

1. A line array acoustical transducer reflector system having a conical shell radiation pattern comprising, a plurality of transducer elements vertically stacked and electrical-mechanically insulated from each other, a disc-shaped metal reflector plate covered with a layer of pressure release material, said elements joined at one end to the center of said plate, and a plurality of transformers for shading said elements individually contained in ferrite cup cores and having a primary winding and a plurality of output windings, each of said transformers connecting several transducer elements to an electrical source and said output windings connecting each element with opposite polarity to its adjacent element.

2. The transducer-reflector system of claim 1 wherein said transducer elements are piezoelectric elements and said pressure release material is corprene.

3. An underwater acoustical transducer reflector system having a conical shell radiation pattern comprising, a plurality of piezoelectric cylindrical elements vertically stacked in a linear array and electrical-mehanically insulated from each other, a flat aluminum disc plate covered on one side with a layer of corprene fixedly attached at the center of said one side to one end of said linear array of elements, and transformer means coupling electrical energy to said piezoelectric elements.

* * * * *